United States Patent [19]

Johnson, Jr.

[11] 4,255,131

[45] Mar. 10, 1981

[54] APPARATUS AND METHOD FOR HEATING AN AGGREGATE MATERIAL

[76] Inventor: Allen S. Johnson, Jr., P.O. Drawer 1037, Salisbury, N.C. 28144

[21] Appl. No.: 95,446

[22] Filed: Nov. 19, 1979

Related U.S. Application Data

[63] Continuation-in-part of Ser. No. 88,522, Oct. 26, 1979.

[51] Int. Cl.[3] ..... F27B 15/00; F27B 7/02; F26B 17/12

[52] U.S. Cl. ..... 432/14; 34/171; 432/16; 432/106

[58] Field of Search ..... 432/14, 15, 16, 58, 432/79, 96, 97, 106; 34/171

[56] References Cited

U.S. PATENT DOCUMENTS

| | | | |
|---|---|---|---|
| 245,602 | 8/1881 | Barton | 34/171 |
| 2,407,636 | 9/1946 | Engler et al. | 34/171 X |
| 3,592,453 | 7/1971 | Jager | 34/79 |
| 3,692,285 | 9/1972 | Avery | 432/79 |
| 3,986,818 | 10/1976 | Devssner et al. | 432/106 |

FOREIGN PATENT DOCUMENTS

| | | | |
|---|---|---|---|
| 277495 | 8/1914 | Fed. Rep. of Germany | 34/171 |
| 725858 | 10/1942 | Fed. Rep. of Germany | 34/171 |

*Primary Examiner*—John J. Camby

*Attorney, Agent, or Firm*—Bell, Seltzer, Park & Gibson

[57] ABSTRACT

Relatively coarse aggregate is preheated to a relatively high temperature prior to introduction into a rotary kiln by directing the aggregate downwardly along a predetermined path of travel while maintaining the aggregate in the form of a relatively thin layer and while directing the waste heated gases from the kiln upwardly along a predetermined sinuous path of travel repeatedly passing laterally back and forth through the downwardly moving layer of aggregate from opposite sides thereof to thus provide highly effective contact of the gas with the aggregate, and while supplementally heating the waste heated gases so as to preheat the aggregate to a higher degree. The thin layer of aggregate is guided downwardly through the preheater housing along a passageway formed by a pair of gas permeable retaining walls which extend generally vertically in opposing spaced relation to one another, and which are of a nonlinear zigzag configuration so arranged as to direct the thin layer of aggregate along a sinuous path of travel in the course of its downward movement along the elongate passageway. The supplemental heating means preferably includes a fuel burner located in the lower portion of the preheater housing in the path of the incoming waste heated gases which are received from the kiln for further heating the gases prior to the gases being directed upwardly and into contact with the aggregate.

23 Claims, 5 Drawing Figures

FUEL SOURCE
11
12
17
30
30a
30b
31
33
35
36
37
38
42
46
47
48
51
a
b

APPARATUS AND METHOD FOR HEATING AN AGGREGATE MATERIAL

CROSS REFERENCE TO RELATED APPLICATIONS

This application is a continuation-in-part of my copending application Ser. No. 088,522 filed Oct. 26, 1979 and entitled APPARATUS AND METHOD FOR TREATING AN AGGREGATE MATERIAL WITH A FLOWING GAS.

FIELD OF THE INVENTION

This invention relates to an apparatus and method for heating a solid aggregate material, and in particular to an improved apparatus and method for use in conjunction with a rotary kiln for preheating the aggregate prior to introduction thereof into the kiln.

BACKGROUND OF THE INVENTION

The aforementioned copending application discloses an improved apparatus and method for preheating solid aggregate material prior to introduction into a rotary kiln by contacting the incoming aggregate with the waste heated gases which are discharged from the kiln. In accordance with the apparatus and method disclosed therein, the aggregate is directed downwardly along a predetermined path of travel while being maintained in the form of a relatively thin layer and while the heated gases which are discharged from the kiln are directed upwardly along a predetermined sinuous path of travel repeatedly passing back and forth through the downwardly moving thin layer of aggregate from the opposite sides thereof to thus provide highly effective contact of the gas with the aggregate. The thin layer of aggregate is guided downwardly along a passageway formed by a pair of gas permeable retaining walls which extend generally vertically in opposing relation to one another. The retaining walls are of a nonlinear zigzag configuration so arranged as to direct the thin layer of aggregate along a sinuous or zigzag path of travel in the course of its downward movement along the elongate passageway.

SUMMARY OF THE INVENTION

The present invention represents an improvement over the apparatus and method of my aforementioned copending application in that it provides for preheating the aggregate to a higher temperature prior to introducing the aggregate into the rotary kiln. This is accomplished by providing supplemental heating means in the preheater for further heating the waste heated gases which are discharged from the rotary kiln so that the thus heated gases will more rapidly bring the aggregate to a preheated condition as the heated gases are directed into contact with the downwardly moving layer of aggregate. More particularly, the supplemental heating means preferably includes a fuel burner located in the lower portion of the preheater housing in the path of the incoming waste heated gases which are received from the kiln for thus further heating the gases prior to the gases being directed upwardly and into contact with the aggregate.

The supplemental heating means which is provided in the preheater apparatus in accordance with the present invention permits heating the incoming aggregate to a significantly higher temperature prior to being introduced into the rotary kiln. Thus, less heating of the aggregate is required in the rotary kiln and the kiln can be reduced in size and operated at a faster rate to achieve a significant increase in production. Additionally, by reducing the amount of heating which takes place in the kiln while increasing the amount of heating which takes place in the preheater apparatus, there is a reduction of fuel consumption by the rotary kiln burner and a reduction in heat losses from the rotary kiln.

BRIEF DESCRIPTION OF THE DRAWINGS

Some of the features and advantages of the invention having been stated, others will become apparent as the description proceeds when taken in connection with the accompanying drawings, in which.

DESCRIPTION OF THE ILLUSTRATED EMBODIMENT

Figure 1:
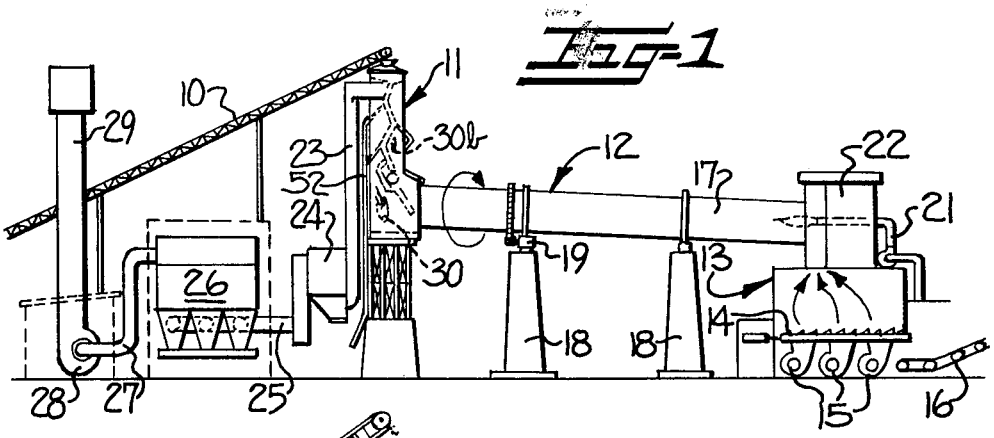
FIG. 1 is a somewhat schematic elevational view showing an assembly of apparatus for processing aggregate in a kiln, and showing an aggregate preheater apparatus constructed in accordance with this invention.

Referring now more particularly to the drawings, FIG. 1 illustrates an assembly of apparatus for processing and heat treating an aggregate material through a rotary kiln. Such an apparatus may be useful, for example, for calcining limestone or for roasting various other kinds of minerals or ores. The minerals or other materials which are processed through the illustrated apparatus are referred to herein by the term "aggregate," but it is to be understood that this term is not intended to be limited to a mineral or rock of any particular chemical composition. The illustrated apparatus is particularly designed for processing relatively coarse aggregate in the form of chunks of a size up to about two to three inches across, as distinguished from fine granular or powdered material of a size comparable to sand, for example. The illustrated apparatus is particularly suited for processing aggregate which has been at least partially preclassified as to size, and preferably within the size range of from about ¾" to about 1½".

The apparatus illustrated in FIG. 1 includes a conveyor 10 for conveying the aggregate from a supply source, not shown, to the upper end of an aggregate preheater, generally indicated by the reference character 11. The aggregate is advanced slowly downwardly through the preheater 11, as described more fully later, while being contacted with heated gases from a rotary kiln, generally indicated by the reference character 12. The aggregate is thus preheated by the heated gases prior to being introduced into the kiln 12. The preheated aggregate is then advanced longitudinally through the rotary kiln 12 while being heated to the desired temperature, and is discharged from the kiln at the opposite end thereof and deposited in an aggregate cooler, generally indicated by the reference character 13. The cooler 13 is of a known construction and includes a grate 14 on which the heated aggregate is deposited, and a plurality of fans 15 mounted for directing air through the grate 14 and into contact with the heated aggregate for cooling the same. The thus cooled aggregate is removed from the grate 14 and deposited on a conveyor 16 which conveys the aggregate elsewhere for storage or subsequent use.

The air which passes through the aggregate in the cooler 13 is heated by the aggregate and is directed from the cooler 13 into one end of the elongate rotary kiln 12. The kiln, more particularly, includes an elongate hollow tubular body 17 which is mounted for rotation about its longitudinal axis on suitable supporting columns 18, with a drive motor 19 being suitably connected to the tubular body for imparting rotation thereto in the direction indicated by the arrow. The tubular body 17 is oriented on a gradual incline as is conventional so that rotation of the tubular body will gradually advance the aggregate longitudinally through the kiln. The kiln 12 further includes a burner 21, fired by powdered coal or other suitable fuel, and mounted in a suitable housing 22 at the discharge end of the tubular body 17. The burner 21 directs a flame longitudinally into the interior of the tubular body 17 of the kiln for thus heating the aggregate contained in the kiln to a desired temperature. The heated air from the fans 15 and the combustion gases from the burner 21 travel longitudinally through the hollow tubular body 17 of the kiln in a direction countercurrent to the direction of the aggregate therethrough and are discharged from the opposite end of the tubular body into the preheater 11. Preferably, the amount of air which is directed into and through the tubular body of the kiln is substantially in excess of that required by the burner 21 for combustion. For example, the rotary kiln is desirably operated with an excess air ratio of about 900%.

Upon being discharged from the rotary kiln, the heated air and combustion gases are directed upwardly through the preheater 11 and are brought into contact with the incoming aggregate for thus preheating the aggregate prior to its introduction into the kiln. As the heated air and combustion gases enter the base of the preheater 11, they are further heated by a supplemental heating means, such as the illustrated gas burner 30 which will be described in more detail later. The heated gases then flow upwardly and pass repeatedly through the thin layer of aggregate transferring the heat content to the downwardly moving layer of aggregate. By the time the gases are discharged from the preheater, the gas temperature has been substantially lowered, with the heat content thereof having been transferred to the incoming aggregate. In order to achieve a highly effective transfer of heat, the heated gases are preferably directed through the preheater at a relatively high volumetric flow rate and velocity e.g. up to about 50 cubic feet per second.

The gases are discharged from the preheater 11 at the upper end thereof and are directed via a duct 23 to a dust collection box 24 where heavier particles of dust and other particulate matter are separated from the flowing gas stream. The gases are then directed via a duct 25 to a suitable filtration apparatus, generally indicated by the reference character 26. In the embodiment of the invention illustrated, the filtration apparatus 26 is a baghouse of a type conventionally employed for removing dust and other fine particulate material from a stream of flowing gas, the baghouse containing a plurality of elongate tubular baglike filters. From the filtration apparatus 26 the gases are directed along a duct 27, through a fan 28 which serves for inducing the flow of gases through the baghouse and through the preheater and kiln, with the gases then being discharged to the atmosphere via a smokestack 29.

In an aggregate heat treating system which relies solely on a rotary kiln for heating the aggregate, such as in my aforementioned copending application, for example, the kiln typically produces a temperature of about 2,300° F. at the burner end with the heated gases being discharged at the opposite end of the kiln at about 1,050°–1,250° F. The heat content of the discharged gases may then be utilized for preheating the aggregate, and is typically effective to preheat the incoming aggregate to a maximum temperature of about 700°–900° F. The provision of supplemental heating means in the preheater in accordance with the present invention raises the temperature of the gases to a considerably higher level, e.g. about 1,500° F., and the incoming aggregate can thus be preheated to a significantly higher temperature, e.g. to about 1,300° F. for example. Thus, the heating load on the rotary kiln is reduced, which permits operating the kiln with less fuel and at a faster rate so as to achieve a substantial increase in production capacity. The size of the rotary kiln may also be significantly reduced.

The preheater apparatus 11 is constructed so as to be highly efficient in transferring heat from the exhaust gases to the incoming aggregate. Consequently, the temperature of the gases discharged from the preheater 11 is quite low, typically about 150°–200° F. This permits the exhaust gases to be conveyed directly to the filtering apparatus 26 without the necessity of providing auxiliary cooling means or bleeding in ambient air to reduce the temperature of the gas as has heretofore been necessary in most previously known aggregate heat treating systems. By efficiently capturing the otherwise wasted heat of the discharged gases and transferring such heat to the incoming aggregate, a considerable amount of otherwise wasted energy is saved and the fuel requirements of the heat treating apparatus are reduced.

Figure 2:
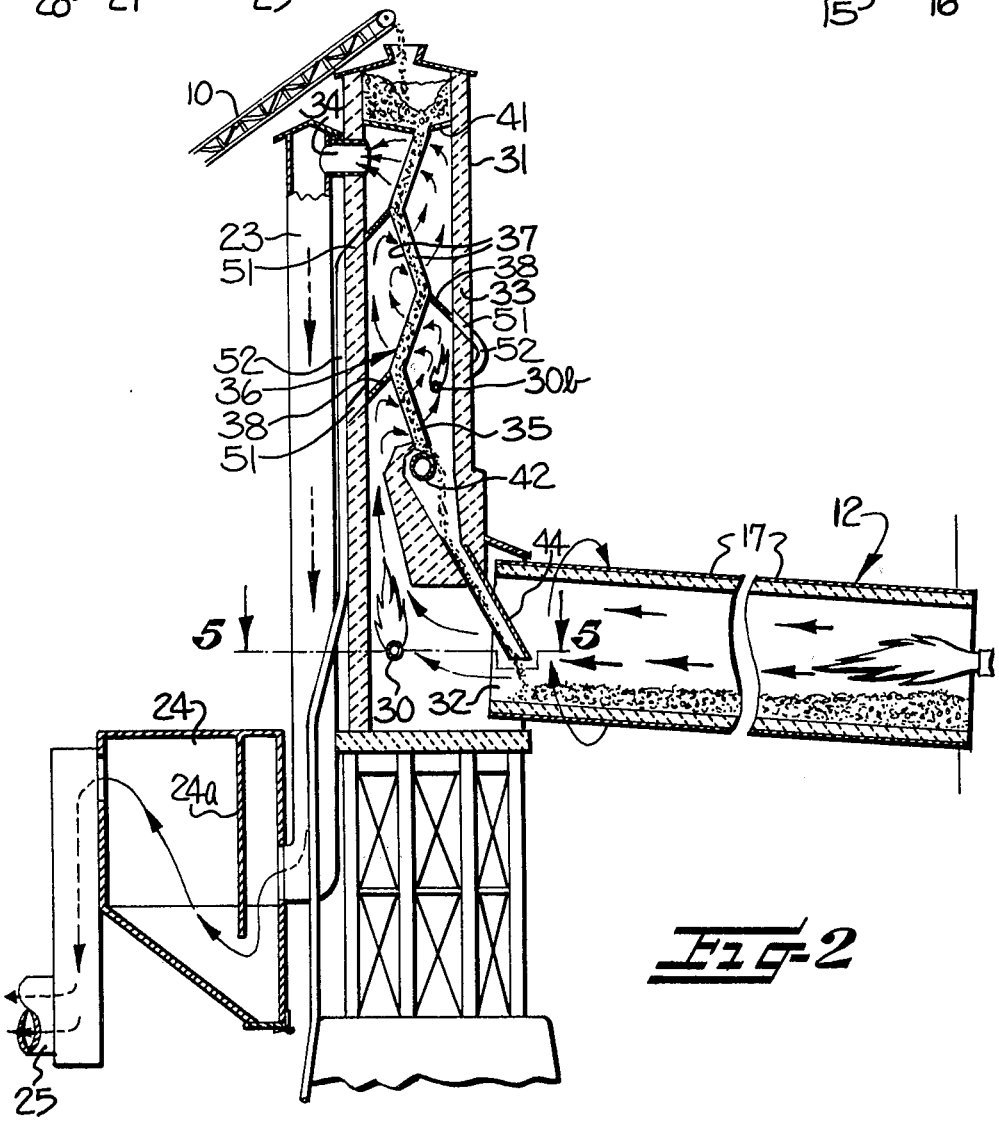
FIG. 2 is a side cross sectional view of the preheater apparatus and the rotary kiln.
Figures 3, 4, 5:
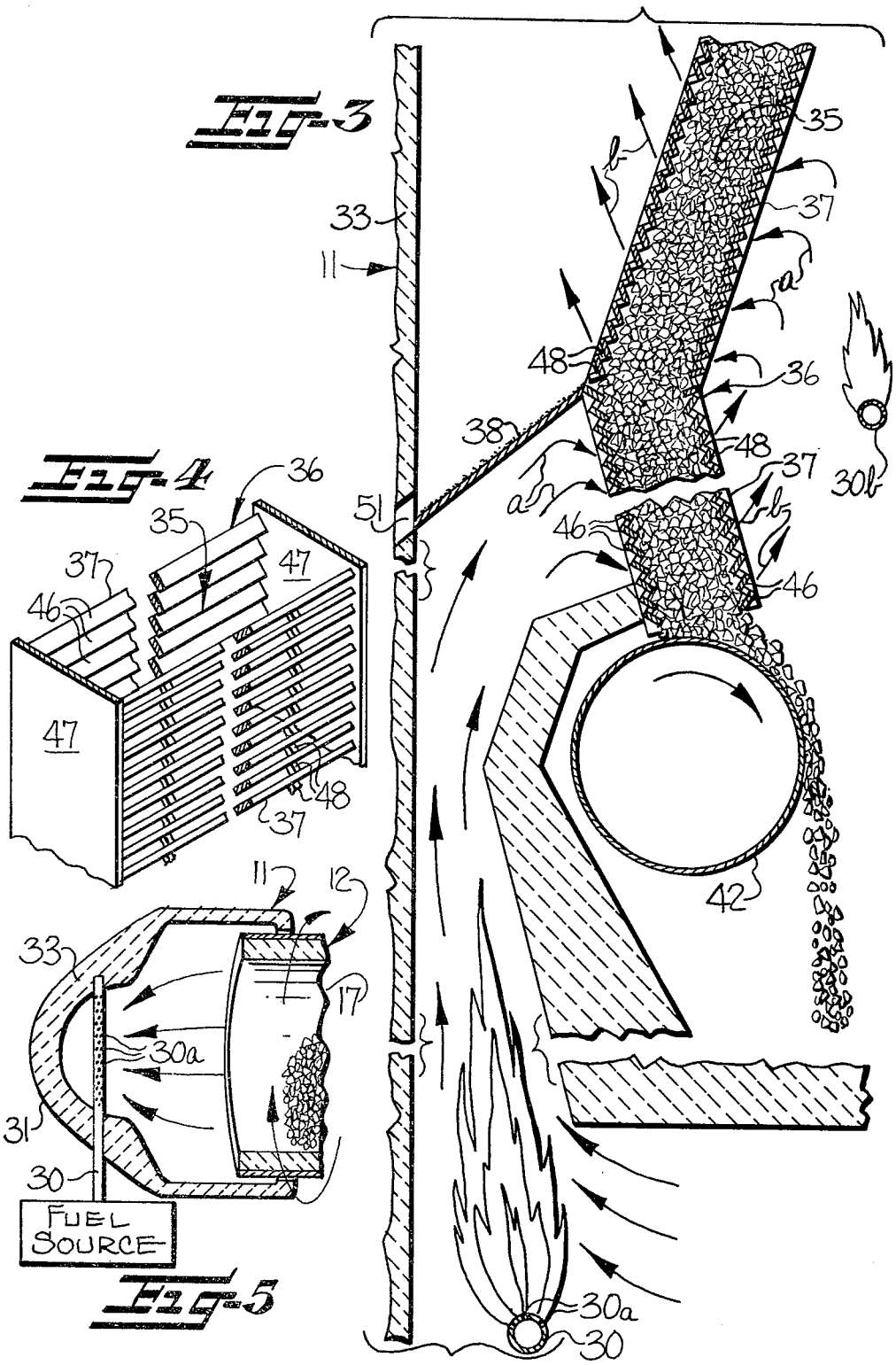
FIG. 3 is an enlarged detailed cross sectional view of a portion of the preheater apparatus.
FIG. 4 is a detailed perspective view showing the construction of the louvered retaining walls in the interior of the preheater.
FIG. 5 is a cross sectional view of the preheater apparatus taken substantially along the line 5–5 in FIG. 2.

Referring now more particularly to the construction of the aggregate preheater 11, as best illustrated in FIGS. 2 and 3, it will be seen that the preheater includes an elongate upright hollow housing 31, which in the illustrated embodiment is of a circular cross section. Housing 31 has an inlet opening 32 adjacent the lower end thereof which is communicatively connected to one end of the tubular body 17 of the rotary kiln 12 for receiving the hot waste gases which are discharged therefrom. The housing 31 is lined with a suitable insulating material 33 for protectively insulating the housing 31 and preventing radiation heat losses therefrom. An outlet opening 34 is provided in the housing 31 adjacent the upper end thereof through which the flowing gases leave the housing 31 and are directed along duct 23 to the dust collection box 24.

Located within the housing 31 is a supplemental heat source for further heating the gases flowing through the housing 31 so that the incoming aggregate can be preheated to a higher temperature. In the embodiment of the invention illustrated, the heated air and combustion gases which are received from the kiln are further heated by a supplemental burner which combusts a fuel in contact with the heated gases from the kiln. More particularly, as illustrated, a gas burner 30 is provided in the lower portion of the housing 31. The gas burner 30 comprises a horizontally extending pipe having a series of orifices 30*a* (FIG. 5) distributed therealong for discharging gas fuel into the flowing stream of heated air and combustion gases. Because of the very high temperature of the flowing gases at this location in the preheater and the excess amount of air present, the gas will readily ignite upon being discharged from the burner 30.

The preheater apparatus may optionally be provided with an additional supplemental heat source, such as an additional gas burner **30*b* located higher in the housing. Burner 30*b* may be used alone or in combination with the burner 30 for supplying additional heat to the upwardly flowing gases. As illustrated, the additional gas burner 30*b*** is located for heating the gases after they have made one pass through the thin layer of aggregate.

Located within the housing 31 above the gas burner 30 is a pair of longitudinally extending retaining walls 36 which are mounted in opposing closely spaced relation to one another to define therebetween an elongate vertically extending passageway or chute 35 for the aggregate. The elongate passageway 35 is of relatively narrow cross section for receiving the aggregate at the upper end thereof and maintaining the aggregate in the form of a relatively thin layer or bed, as for example four to five inches thick, as it is directed downwardly along the passageway 35. As illustrated, the retaining walls 36 are of a nonlinear zigzag configuration so that the thin layer of aggregate is directed along a sinuous path of travel in the course of its downward movement along the narrow aggregate passageway.

The nonlinear zigzag retaining walls 36 are each comprised of a series of inclined segmental wall portions 37, with each segmental wall portion being inclined at a relatively small angle from the vertical axis. Preferably, the angle of incline of the respective segmental wall portions 37 is within the range of about 10° to about 25° from the vertical axis, and most desirably about 17° to 18°. The respective segmental wall portions which collectively define each retaining wall are so arranged that alternate segmental wall portions are inclined to one side of the vertical axis, with the intervening segmental wall portions being inclined to the opposite side of the vertical axis. The thin layer of aggregate is thus directed laterally back and forth in opposite directions along a series of downwardly inclined courses of travel as it progresses downwardly through the elongate passageway 35.

The retaining walls 36 which form the elongate aggregate passageway or chute 35 are of a gas permeable construction to freely allow the heated gases within the housing 31 to flow through the thin layer of aggregate. As illustrated, the arrangement of the zigzag gas permeable retaining walls 36 within the hollow interior of the housing 31 is such that the heated gases flowing along the interior of the housing are repeatedly directed through the retaining walls 36 and into contact with the thin layer of aggregate which is trapped therebetween. More particularly, it will be seen that a series of imperforate baffle plates 38 extend outwardly from the retaining walls 36, to the surrounding housing at spaced locations along the longitudinal extent of the retaining walls so as to direct the flowing gases in a sinuous upward path of travel which repeatedly passes laterally back and forth through the retaining walls and thus repeatedly directs the heated gases into and through the downwardly advancing thin layer of aggregate.

As best seen in FIG. 2, a wall 41 extends between the uppermost ends of the retaining walls 36 and the surrounding housing 31 to define a hopper at the upper end of the housing for receiving a supply of the aggregate with the wall 41 being inclined toward the open upper end of the elongate passageway 35 for directing the aggregate into the passageway. An elongate cylindrical roll 42 is positioned beneath the lower end of the retaining walls 36 in obstructing relationship to the lower end of the passageway 35 so that the passageway remains substantially filled with aggregate. The roll 42 is rotatably driven by a drive motor for discharging the aggregate from the lower end of the passageway at a controlled metered rate. Preferably, the speed of rotation of the drive motor is correlated with the speed of rotation of the rotary kiln so that as the speed of the kiln is increased, the speed of the roll 42 is correspondingly increased so as to thereby feed aggregate into the kiln at a faster rate. Upon its discharge from the lower end of the passageway 35, the preheated aggregate falls by gravity through an inlet pipe 44 and into the interior of the rotary kiln 12.

As best seen in FIG. 4, the gas permeable retaining walls 36 which define the aggregate passageway 35 are of a louvered construction and comprised of a series of parallel laterally extending slats 46 which extend substantially the full width of the chute 35 and are connected to opposing solid end walls 47. The slats 46 in each series are spaced apart from one another to readily permit the flow of gas therebetween, with reinforcing spacers 48 being mounted between adjacent slats at spaced locations across the width thereof to provide enhanced structural rigidity to the retaining wall. As illustrated, the slats 46 are inclined angularly downwardly in the direction of movement of the aggregate and are convergingly arranged with the opposing series of slats. The slats of each series are positioned in overlapping relation to one another to assist in guiding the aggregate along its downward path of travel while confiningly retaining the aggregate within the elongate passageway and while also readily permitting the flow of gas into and through the thin layer of aggregate.

As earlier noted, the respective segmental wall portions 37 which collectively define the retaining walls 36 are oriented at an incline with respect to the vertical axis so that the advancing column of aggregate moves downwardly along an inclined sinuous or zigzag path of travel. The upward flow of gases through the respective segmental wall portions is such that the gases always enter the thin layer of aggregate on the lower of the pair of opposing wall segments, and emerge from the layer through the upper of the pair of segmental wall portions. Thus, as indicated by the air flow arrows a in FIG. 3, the louvered construction of the segmental wall portions 37 causes the heated gases to be directed into the inclined thin layer of aggregate angularly downwardly in generally the same direction as the direction of movement of the aggregate. The flow of the gas thus assists in the downward movement of the layer of aggregate, rather than interfering with or opposing the movement of the aggregate as might occur if the gas flow passed through the layer of aggregate in a different direction. This is quite significant at the high air velocities which are preferably utilized in the preheater apparatus. By directing the airflow angularly through the layer of aggregate, the louvered construction of the wall portion 37 also serves to increase the distance which the gas must travel through the layer, thus enhancing contact and heat transfer between the gas and the aggregate.

The inclined angular orientation of the segmental wall portions 37 is also quite significant in obtaining effective removal of dust and other fine particulate material from the aggregate and in preventing clogging of the air passageways between the respective slats 46 as a result of accumulation of dust between the slats. This will best be understood by again referring to FIG. 3. As illustrated, the aggregate which is located closest to the lower of the opposing pair of inclined segmental wall portions 37, i.e. the wall on the inflow side where the air enters the layer of aggregate, is in a relatively compacted state since it bears the weight of the overlying aggregate. However, the aggregate which is located closest to the outflow wall, i.e. the upper of the pair of inclined segmental wall portions in FIG. 3, does not bear the weight of the overlying aggregate and is thus more loosely compacted. This permits the looser aggregate to move and turn as it advances downwardly in the column and permits any dust which is carried by the aggregate to be readily swept away by the outflowing current of gases. Furthermore, the slats 46 on the outflow wall are oriented angularly upwardly at a relatively steep incline and, as indicated by the flow arrows b in FIG. 3, the gases are directed between the slats in an angularly upward direction. The relatively steep inclined orientation of the slats assists in keeping the air passageways clear of any accumulated dust, since the exposed surfaces of the slats are inclined too steeply for the dust to accumulate thereon and the flowing air will tend to sweep away any dust which may accumulate on the slat surfaces.

When dust or other particulate material is removed from the column of aggregate, the heavier particles have a tendency to settle out or fall rather than being swept along with the flowing gas stream, and the dust or particulate material settles on the upper surface of the baffle plates 38. As illustrated in FIG. 2, the baffle plates are inclined downwardly from the retaining walls 36 outwardly toward the surrounding housing 31 and thus serve for directing the dust or particulate material outwardly toward the housing 31. Since the surrounding housing is of a circular cross section, the inclined baffle plates 38 are of a semi-elliptical shape and thus serve to convergingly direct the accumulated dust or particulate material to a common location at the lowest point on the plate. An opening 51 is provided in the wall of the housing 31 at this location through which the accumulated dust may be removed from the housing, and a conduit 52 (FIG. 2) is communicatively connected thereto for carrying away the dust to a suitable collection site. Similar openings 51 and conduits 52 are associated with each of the baffle plates 38 in the preheater.

Because of the zigzag construction of the retaining walls 36 and the arrangement of the baffle plates 38 the heated gases from the kiln are repeatedly directed through the thin layer of aggregate from alternate directions, i.e. first from one side of the thin layer and then from the other side thereof. Consequently, a different side or face of the aggregate is exposed to the flowing gases with each pass so as to thereby maximize the transfer of heat from the flowing gases to the aggregate.

After repeatedly passing back and forth through the thin layer of aggregate and reaching the upper portion of the housing 31, the gases have been substantially reduced in temperature and the heat content thereof transferred to the aggregate. The thus cooled gases leave the housing via the outlet opening 34 and are directed along duct 23 to the dust collection box 24, where the gases are directed beneath a baffle 24*a*. Because of the substantially larger cross sectional flow area for the gases inside the dust collection box 24, the gases are substantially reduced in velocity, which permits additional amounts of dust and particulate material, previously entrained in the flowing gas, to drop out of the gas stream prior to the gas stream being directed to the filtering apparatus 26.

While the drawings and specification have illustrated and described how the apparatus and method of this invention may be used as a preheater in association with a rotary kiln, the invention is susceptible to numerous other applications and uses, alone or in association with a kiln or other apparatus. Those skilled in the applicable arts will recognize that the apparatus and method of this invention has broad applicability in situations where it is desirable to contact or treat an aggregate material with a flowing heated gas.

In the drawings and specification there have been set forth preferred embodiments of the invention, and although specific terms are employed, they are used in a generic and descriptive sense only and not for purposes of limitation.

That which is claimed is:

1. In an apparatus for heat treating a solid aggregate, said apparatus including a rotary kiln having an elongate tubular rotatable body through which the aggregate is advanced and including means for directing heated gases through said tubular body in a direction countercurrent to the movement of the aggregate for heating the aggregate to elevated temperature, the combination therewith of an aggregate preheater cooperating with said kiln for preheating the aggregate prior to introduction thereof into said kiln to thus significantly reduce the energy requirements for heat treatment of said aggregate while also significantly increasing the production capacity of said kiln, said preheater comprising means defining an elongate generally vertically extending gas permeable passageway of relatively narrow cross section adapted for receiving aggregate at the upper end thereof and confiningly directing the aggregate along a predetermined downward path of travel in the form of a relatively thin layer, means for receiving the heated gases from said kiln and directing the gases upwardly along a predetermined sinuous path of travel repeatedly passing laterally through said gas permeable passageway so as to repeatedly direct the gases through the thin layer of aggregate in said passageway, and supplemental heating means cooperating with said receiving and directing means for further heating the gases from said kiln so that the thus heated gases will rapidly bring the aggregate to a preheated condition as the heated gases are directed into contact with the aggregate.

2. The apparatus as set forth in claim 1 wherein said means defining said elongate gas permeable passageway comprises a pair of gas permeable retaining walls extending generally vertically in opposing, spaced relation to one another to define said elongate passageway therebetween.

3. The apparatus as set forth in claim 2 wherein each of said gas permeable retaining walls is of a nonlinear zigzag configuration and comprised of a series of interconnected inclined segmental wall portions, the respective segmental wall portions of said pair of retaining walls collectively defining an elongate vertically extending sinuous passageway for the aggregate, and wherein said means for directing the heated gases upwardly cooperates with said segmental wall portions for directing the heated gases along a sinuous upward path and laterally through each of the inclined segmental wall portions so as to thereby repeatedly direct the heated gases laterally back and forth through the thin layer of aggregate in said passageway.

4. In an apparatus for heat treating a solid aggregate, said apparatus including a rotary kiln having an elongate tubular rotatable body through which the aggregate is advanced and including means for directing heated gases through said tubular body in a direction countercurrent to the movement of the aggregate for heating the aggregate to elevated temperature, the combination therewith of an aggregate preheater cooperating with said kiln for preheating the aggregate prior to introduction thereof into said kiln to thus significantly reduce the energy requirements for heat treatment of said aggregate while also significantly increasing the production capacity of said kiln, said preheater comprising an upright hollow housing having an inlet opening in a lower portion thereof and an outlet opening in an upper portion thereof, means for receiving the heated gases from said kiln and directing the same into the inlet opening of said housing, means defiling an elongate zigzag gas permeable passageway of relatively narrow cross section extending generally vertically within said upright hollow housing and traversing laterally back and forth therein to form a series of oppositely directed downwardly inclined courses of travel, said zigzag passageway being adapted for receiving aggregate at the upper end thereof and confiningly directing the aggregate downwardly along an inclined zigzag path of travel in the form of a relatively thin layer of aggregate, supplemental heating means provided within said hollow housing for further heating the gases from said kiln, and means cooperating with said zigzag passageway for directing the heated gases upwardly along a predetermined sinuous path of travel passing successively through each of the oppositely directed downwardly inclined courses of travel of the layer of aggregate along said zigzag passageway so that the heated gases thus repeatedly flow laterally back and forth through the thin layer of aggregate from opposite sides thereof, each time entering the inclined layer from the underside thereof and emerging from the upper side of the inclined layer to thereby provide highly effective contact of the heated gases with the aggregate.

5. The apparatus as set forth in claim 4 wherein said supplemental heating means comprises a fuel burner located within said housing adjacent the lower end of said zigzag passageway and in the path of the incoming heated gases from said kiln.

6. In an apparatus for heat treating a solid aggregate, said apparatus including a rotary kiln having an elongate tubular rotatable body through which the aggregate is advanced and including a burner at one end thereof for heating gases which are directed through said tubular body in a direction countercurrent to the movement of the aggregate for heating the aggregate to elevated temperature, the combination therewith of an aggregate preheater cooperating with said kiln for preheating the aggregate prior to introduction thereof into said kiln to thus significantly reduce the energy requirements for heat treatment of said aggregate while also significantly increasing the production capacity of said kiln, said preheater comprising an upright hollow housing having an inlet opening in a lower portion thereof and an outlet opening in an upper portion thereof, means for receiving the heated gases from said kiln and directing the same into the inlet opening of said housing, a supplemental burner located in said housing for further heating the gases received from said kiln, a pair of opposing gas permeable louvered retaining walls positioned within said upright housing and extending generally longitudinally thereof in closely spaced relation to one another to define an elongate generally vertically extending passageway of relatively narrow cross section adapted for receiving the aggregate at the upper end thereof and directing the same along a predetermined downward path of travel in the form of a relatively thin downwardly moving layer, said pair of louvered retaining walls being of a nonlinear zigzag configuration, and each comprised of a series of interconnected inclined segmental wall portions so arranged as to direct the thin layer of aggregate along a sinuous path of travel in the course of its downward movement along said elongate passageway, means cooperating with the respective segmental wall portions of said pair of retaining walls and with the surrounding housing for directing the heated gases flowing within said housing successively through each of said segmental wall portions so as to thereby repeatedly direct the heated gases laterally back and forth through the thin layer of aggregate in said passageway to provide highly effective contact of the gas with the aggregate, and means cooperating with said pair of retaining walls adjacent the lower end thereof for controlling the discharge of the aggregate from said passageway.

7. The apparatus as set forth in claim 6 wherein each of said opposing louvered retaining walls comprises a series of laterally extending slats and wherein the slats of the opposing series are convergingly arranged and inclined angularly downwardly in the direction of movement of the aggregate to assist in guiding the aggregate along its downward path of travel while confining the aggregate within the passageway and while also readily permitting the flow of the heated gases into and through the thin layer of aggregate.

8. The apparatus as set forth in claim 6 wherein alternate segmental wall portions of each series of interconnected segmental wall portions are inclined to one side of a vertical axis and wherein intervening segmental wall portions of said series are inclined to the opposite side of said vertical axis.

9. The apparatus as set forth in claim 8 wherein said segmental wall portions are inclined at an angle of from about 10° to about 25°.

10. Apparatus for heating a solid aggregate, said apparatus comprising an upright hollow housing having an inlet opening in a lower portion thereof and an outlet opening in an upper portion thereof, means for directing a flowing gas into the inlet opening of said housing, means defining an elongate zigzag gas permeable passageway of relatively narrow cross section extending generally vertically within said upright hollow housing and traversing laterally back and forth therein to form a series of oppositely directed downwardly inclined courses of travel, said zigzag passageway being adapted for receiving aggregate at the upper end thereof and confiningly directing the aggregate downwardly along a zigzag path of travel in the form of a relatively thin layer of aggregate, means provided within said housing adjacent the lower end of said zigzag passageway for heating the flowing gas upon entering said housing, and means for directing the thus heated gas upwardly along a predetermined sinuous path of travel passing successively through each of the oppositely directed downwardly inclined courses of travel of the layer of aggregate along said zigzag passageway so that the heated gas thus repeatedly flows laterally back and forth through the thin layer of aggregate from opposite sides thereof, each time entering the inclined layer from the underside thereof and emerging from the upper side of the inclined layer to thereby provide highly effective contact of the heated gas with the aggregate.

11. The apparatus as set forth in claim 10 wherein said means defining said elongate zigzag gas permeable passageway comprises a pair of gas permeable retaining walls of a nonlinear zigzag configuration extending in opposing, spaced relation to one another to define said elongate zigzag passageway therebetween.

12. The apparatus as set forth in claim 10 wherein said means for heating the flowing gas comprises a fuel burner located within said housing in the path of the incoming gases through said inlet opening.

13. Apparatus for heating a solid aggregate, said apparatus comprising an upright hollow housing having an inlet opening in a lower portion thereof and an outlet opening in an upper portion thereof, means for directing a flowing gas into the inlet opening of said housing a fuel burner located in said housing adjacent said inlet opening for heating the incoming gases flowing into said housing, a pair of opposing gas permeable louvered retaining walls positioned within said upright housing and extending generally longitudinally thereof in closely spaced relation to one another to define an elongate generally vertically extending passageway of relatively narrow cross section adapted for receiving the aggregate at the upper end thereof and directing the same along a predetermined downward path of travel in the form of a relatively thin downwardly moving layer, said pair of louvered retaining walls being of a nonlinear zigzag configuration, and each comprised of a series of interconnected inclined segmental wall portions so arranged as to direct the thin layer of aggregate along a sinuous path of travel in the course of its downward movement along said elongate passageway, means cooperating with the respective segmental wall portions of said pair of retaining walls and with the surrounding housing for directing the heated gases flowing within said housing successively through each of said segmental wall portions so as to thereby repeatedly direct the heated gases laterally back and forth through the thin layer of aggregate in said passageway to provide highly effective contact of the gas with the aggregate, and means cooperating with said pair of retaining walls adjacent the lower end thereof for controlling the discharge of the aggregate from said passageway.

14. The apparatus as set forth in claim 13 wherein each of said opposing louvered retaining walls comprises a series of laterally extending slats and wherein the slats of the opposing series are convergingly arranged and inclined angularly downwardly in the direction of movement of the aggregate to assist in guiding the aggregate along its downward path of travel while confining the aggregate within the passageway and while also readily permitting the flow of the heated gases into and through the thin layer of aggregate.

15. The apparatus as set forth in claim 13 wherein alternate segmental wall portions of each series of interconnected segmental wall portions are inclined to one side of a vertical axis and wherein intervening segmental wall portions of said series are inclined to the opposite side of said vertical axis.

16. The apparatus as set forth in claim 15 wherein said segmental wall portions are inclined at an angle of from about 10° to about 25°.

17. In a method for heat treating a solid aggregate wherein the aggregate is advanced longitudinally through an elongate rotary kiln while heated gases are directed through the kiln in a direction countercurrent to the movement of the aggregate for heating the aggregate to elevated temperature, the combination therewith of an improved method for preheating the aggregate prior to introduction thereof into the kiln to thus significantly reduce the energy requirements for heat treatment of the aggregate while also significantly increasing the production capacity of the kiln, said method comprising directing the aggregate downwardly along a predetermined path of travel while maintaining the aggregate in the form of a relatively thin layer and while directing the waste heated gases which are discharged from the kiln upwardly along a sinuous path of travel repeatedly passing back and forth through the downwardly moving layer of aggregate from opposite sides thereof to thus effectively transfer the heat content of the heated gases to the aggregate, and while supplementally heating the waste heated gases so as to preheat the aggregate to a higher degree.

18. The method as set forth in claim 17 wherein the step of supplementally heating the waste heated gases comprises heating the gases prior to directing the same upwardly along a sinuous path and into contact with the aggregate.

19. The method as set forth in claim 18 wherein the step of supplementally heating the waste heated gases comprises additionally heating the gases at a location along the sinuous path of travel thereof through the moving layer of aggregate.

20. The method as set forth in claim 17 wherein the step of directing the aggregate downwardly along a predetermined path of travel comprises guiding the layer of aggregate laterally back and forth along a series of oppositely directed downwardly inclined courses of travel, and wherein the step of directing the waste heated gases upwardly along a sinuous path of travel comprises guiding the heated gases successively through each of the oppositely directed downwardly inclined courses of travel of the layer of aggregate so that the gases thus repeatedly flow laterally back and forth through the thin layer of aggregate from opposite sides thereof, each time entering the inclined layer from the underside thereof and emerging from the upper side of the inclined layer.

21. In a method for heat treating a solid aggregate wherein the aggregate is advanced longitudinally through an elongate rotary kiln while heated air and combustion gases are directed through the kiln in a direction countercurrent to the movement of the aggregate for heating the aggregate to elevated temperature, the combination therewith of an improved method for preheating the aggregate prior to introduction thereof into the kiln to thus significantly reduce the energy requirements for heat treatment of the aggregate while also significantly increasing the production capacity of the kiln, said method comprising maintaining the aggregate in the form of a relatively thin layer while guiding the thin layer of aggregate laterally back and forth along a series of oppositely directed downwardly inclined courses of travel, and while directing the heated gases upwardly along a sinuous path of travel passing successively through each of the oppositely directed downwardly inclined courses of travel of the layer of aggregate so that the gases thus repeatedly flow laterally back and forth through the thin layer of aggregate from opposite sides thereof, each time entering the inclined layer from the underside thereof and emerging from the upper side of the inclined layer, thereby effectively transferring the heat content of the heated gases to the aggregate, and while also combusting a fuel in contact with the waste heated gases for supplementally heating the gases so as to preheat the aggregate to a higher degree.

22. The method as set forth in claim 21 wherein the step of combusting a fuel in contact with the waste heated gases comprises combusting the fuel in contact with the gases prior to the gases being directed upwardly along a sinuous path and into contact with the aggregate.

23. A method of heating a solid aggregate by contact with a heated gas, said method comprising maintaining the aggregate in the form of a relatively thin layer while guiding the thin layer of aggregate laterally back and forth along a series of oppositely directed downwardly inclined courses of travel and while directing a heated gas from a predetermined source upwardly along a predetermined sinuous path of travel passing successively through each of the oppositely directed downwardly inclined courses of travel of the layer of aggregate so that the heated gas thus repeatedly flows laterally back and forth through the thin layer of aggregate from opposite sides thereof each time entering the inclined layer from the underside thereof and emerging from the upper side of the inclined layer, and while supplementally heating the heated gas so as to heat the aggregate to a higher degree.

* * * * *